US009475333B2

(12) United States Patent
Yeh

(10) Patent No.: US 9,475,333 B2
(45) Date of Patent: Oct. 25, 2016

(54) ARTICLE WITH REMOVABLE THREE-DIMENSIONAL OBJECT

(71) Applicant: Lawrence Seng Lung Yeh, Long Island City, NY (US)

(72) Inventor: Lawrence Seng Lung Yeh, Long Island City, NY (US)

(73) Assignee: Lawrence Seng Lung Yeh, Long Island City, NY (US)

( * ) Notice: Subject to any disclaimer, the term of this patent is extended or adjusted under 35 U.S.C. 154(b) by 0 days.

(21) Appl. No.: 14/670,495

(22) Filed: Mar. 27, 2015

(65) Prior Publication Data

US 2015/0332611 A1 Nov. 19, 2015

Related U.S. Application Data

(60) Provisional application No. 62/102,298, filed on Jan. 12, 2015, provisional application No. 61/992,553, filed on May 13, 2014.

(51) Int. Cl.

| | |
|---|---|
| ***G09F 1/08*** | (2006.01) |
| ***B42D 15/04*** | (2006.01) |
| ***B44C 5/00*** | (2006.01) |
| ***B44C 5/06*** | (2006.01) |

(52) U.S. Cl.

CPC ..... *B42D 15/045* (2013.01); *B44C 5/00* (2013.01); *B44C 5/06* (2013.01); *G09F 1/08* (2013.01)

(58) Field of Classification Search

CPC ..... G09F 1/06; G09F 1/08; G09F 1/04; B42D 15/042; B42D 15/045; B42D 15/04; A63H 33/38

See application file for complete search history.

(56) References Cited

U.S. PATENT DOCUMENTS 1,891,011 A 12/1932 Purdy
2,511,211 A * 6/1950 Klein ..... B65D 5/4258 206/45.28

(Continued)

FOREIGN PATENT DOCUMENTS

GB 2467115 A 7/2010
WO 2007/149110 A1 12/2007

OTHER PUBLICATIONS

European Search Report for Application No. EP 16 15 0881 dated Mar. 21, 2016; 3 pages.

(Continued)

*Primary Examiner* — Cassandra Davis
(74) *Attorney, Agent, or Firm* — Dentons US LLP

(57) ABSTRACT

In accordance with one aspect of the present disclosure, a greeting card is disclosed that includes a plurality of panels connected such that the greeting card is reconfigurable between a closed configuration and an open configuration, at least one object positioned between the plurality of panels that is reconfigurable between a collapsed configuration and an expanded configuration, and an attachment member connecting the at least one object to the plurality of panels such that the at least one object can be detached from the plurality of panels. In various embodiments, the greeting card may further include a locking member that is configured and dimensioned to maintain the expanded configuration of the at least one object.

13 Claims, 10 Drawing Sheets

(56) References Cited

U.S. PATENT DOCUMENTS

| | | | | |
|---|---|---|---|---|
| 3,343,297 | A | 9/1967 | Valentine | |
| 3,668,796 | A | 6/1972 | Patterson | |
| 4,319,418 | A * | 3/1982 | Transport | B44C 3/12 40/124.14 |
| 5,096,751 | A | 3/1992 | Duchek | |
| 5,261,172 | A | 11/1993 | Rowley | |
| 5,613,612 | A * | 3/1997 | Davault | G11B 23/40 206/308.1 |
| 5,658,620 | A * | 8/1997 | Ross | G09F 1/08 40/539 |
| 5,937,553 | A | 8/1999 | Maran | |
| 6,966,135 | B1 | 11/2005 | McDonald | |
| 7,490,425 | B2 | 2/2009 | Crowell et al. | |
| D662,543 | S | 6/2012 | Dennis et al. | |
| 2007/0017133 | A1* | 1/2007 | Crowell | G09F 15/00 40/610 |
| 2007/0293118 | A1* | 12/2007 | Prescott | A63H 33/38 446/148 |
| 2012/0297650 | A1 | 11/2012 | Burley | |
| 2013/0232828 | A1 | 9/2013 | Qiao et al. | |
| 2013/0302540 | A1 | 11/2013 | Vinecombe | |

OTHER PUBLICATIONS

YouTube video at the link: https://youtube.com/watch?v=2L1mz9B8HAk&autoplay=1; entitled "the kit for making the pop-up ferris wheel," published on Aug. 12, 2012; 12:35.

* cited by examiner

ARTICLE WITH REMOVABLE THREE-DIMENSIONAL OBJECT

CROSS-REFERENCE TO RELATED APPLICATIONS

This application claims the benefit of, and priority to, U.S. Provisional Patent Application Ser. Nos. 61/992,553 and 62/102,298, filed on May 13, 2014 and Jan. 12, 2015, respectively, the entire contents of which are hereby incorporated by reference.

TECHNICAL FIELD

The present disclosure relates generally to an article, e.g., a greeting card, a holiday card, a poster, or the like, that includes a removable three-dimensional object, as well as methods of using and manufacturing the same.

BACKGROUND

Articles including expandable portions that "pop" to display three-dimensional objects are well known. The three-dimensional objects, however, are typically fixed to the article in permanent fashion.

The present disclosure, however, describes an article including one or more three-dimensional objects that are removably (detachably) secured thereto, e.g., to permit display of the object(s) following removal from the article.

SUMMARY

In accordance with one aspect of the present disclosure, a greeting card is disclosed that includes a plurality of panels connected such that the greeting card is reconfigurable between a closed configuration and an open configuration, at least one object that is positioned between the plurality of panels, and an attachment member that connects the at least one object to the plurality of panels such that the at least one object can be selectively detached from the plurality of panels.

The at least one object is reconfigurable between a collapsed configuration and an expanded configuration, and is detachably connected to the plurality of panels such that movement of the greeting card from the closed configuration to the open configuration transitions the at least one object from the collapsed configuration to the expanded configuration, and movement of the greeting card from the open configuration to the closed configuration transitions the at least one object from the expanded configuration to the collapsed configuration.

The at least one object includes a plurality of individual members in mechanical cooperation so as to define a predetermined shape when the at least one object is in the expanded configuration.

In certain embodiments, the at least one object may include a display member to facilitate display of the at least one object following detachment from the plurality of panels.

In certain embodiments, the plurality of panels, the at least one object, and the attachment member may be formed as separate, discrete structures.

In certain embodiments, the attachment member may include a tether that extends between the at least one object and the plurality of panels, and the plurality of panels may include a first outer panel, a second outer panel connected to the first outer panel, a first inner panel connected to an inner surface of the first outer panel, and a second inner panel connected to an inner surface of the second outer panel. In such embodiments, a portion of the tether may pass between the first outer panel and the first inner panel, and a portion of the tether may pass between the second outer panel and the second inner panel.

In another aspect of the present disclosure, a greeting card is disclosed that includes a plurality of panels, at least one object positioned between the plurality of panels that is reconfigurable between a collapsed configuration and an expanded configuration, and a locking member that is configured and dimensioned to maintain the expanded configuration of the at least one object.

The at least one object includes a plurality of individual members in mechanical cooperation so as to define a predetermined shape when the at least one object is in the expanded configuration.

In certain embodiments, the locking member may be defined by a portion of the at least one object.

In certain embodiments, the locking member may be integrally formed with one of the plurality of individual members of the at least one object.

In certain embodiments, the locking member may include a deflectable tab that is movable between a first position, wherein the tab permits collapse of the at least one object, and a second position, wherein the tab inhibits collapse of the at least one object.

In certain embodiments, the deflectable tab may be defined by a weakened portion of the individual member with which the locking member is formed, e.g., one or more perforations.

In certain embodiments, the object may further include a retention structure engageable with the locking member to maintain the locking member in a locked position.

In certain embodiments, the locking member may be configured and dimensioned in correspondence with the at least one object in the expanded configuration such that the locking member is engageable with the plurality of individual members of the at least one object to lock the at least one object in the expanded configuration.

In certain embodiments, the at least one object and the locking member may be formed as separate, discrete structures.

In certain embodiments, the greeting card may further include an attachment member connecting the at least one object to the plurality of panels such that the at least one object can be selectively detached from the plurality of panels.

In certain embodiments, the plurality of panels, the at least one object, and the attachment member may be formed as separate, discrete structures.

In another aspect of the present disclosure, a greeting card is disclosed that includes a plurality of panels, and at least one object positioned between the plurality of panels that is reconfigurable between a collapsed configuration and an expanded configuration.

The least one object includes a plurality of individual members in mechanical cooperation so as to define a predetermined shape when the at least one object is in the expanded configuration, as well as a locking member that is configured and dimensioned to maintain the expanded configuration of the at least one object.

In certain embodiments, the locking member may be integrally formed with one of the plurality of individual members of the at least one object.

In certain embodiments, the locking member may include a deflectable tab that is movable between a first position, wherein the tab permits collapse of the at least one object, and a second position, wherein the tab inhibits collapse of the at least one object.

In certain embodiments, the at least one object may further include a retention structure engageable with the locking member to maintain the locking member in a locked position.

BRIEF DESCRIPTION OF THE FIGURES

Various embodiments of the present disclosure are described herein with reference to the figures, wherein.

DETAILED DESCRIPTION

Various embodiments of the presently disclosed article, and methods of using and manufacturing the same, will now be described in detail with reference to the figures, wherein like references numerals identify similar or identical elements. In the figures, and in the following description, the term "article" should be understood to encompass any card, e.g., greeting card, invitation, etc., book, poster, or the like that includes a three-dimensional object.

Figure 1:
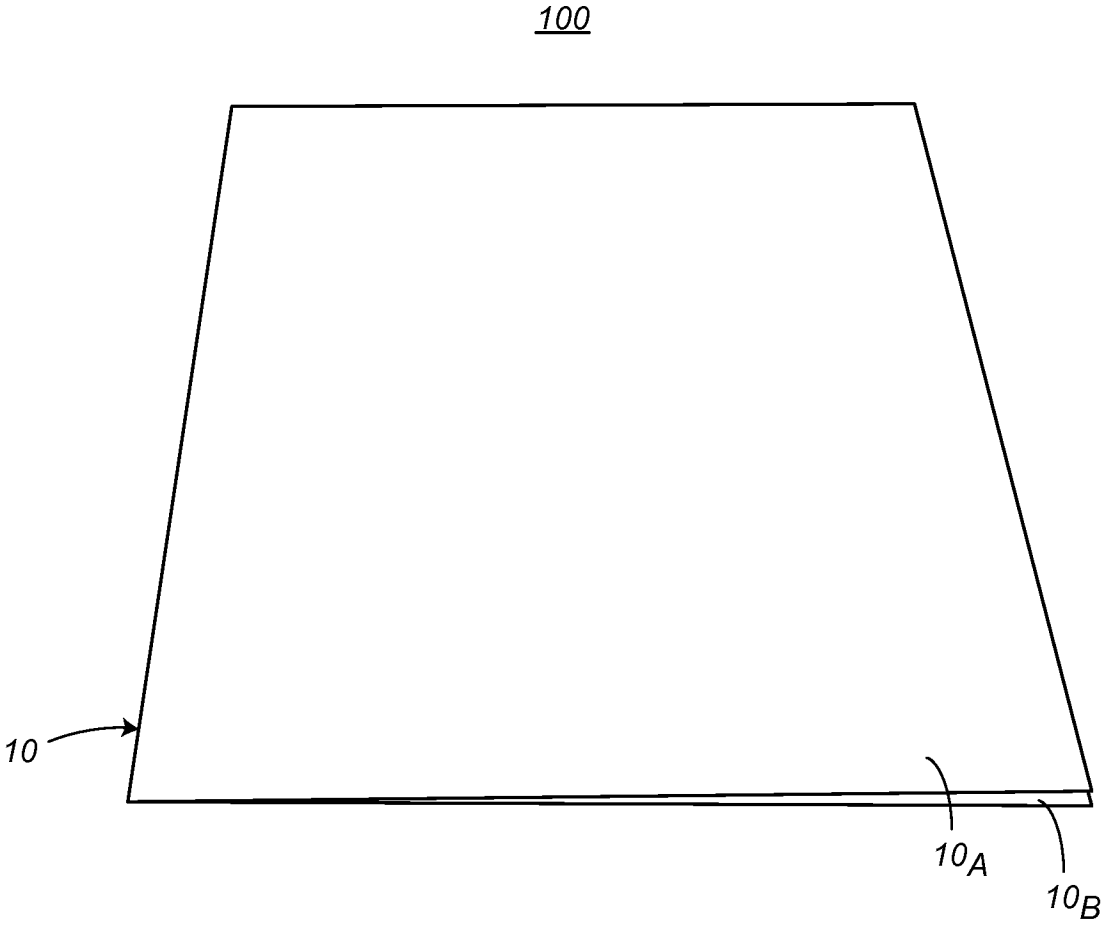
FIG. 1 is a top perspective view of an article including a removable (detachable) three-dimensional object with the article shown in a closed configuration.
Figure 2:
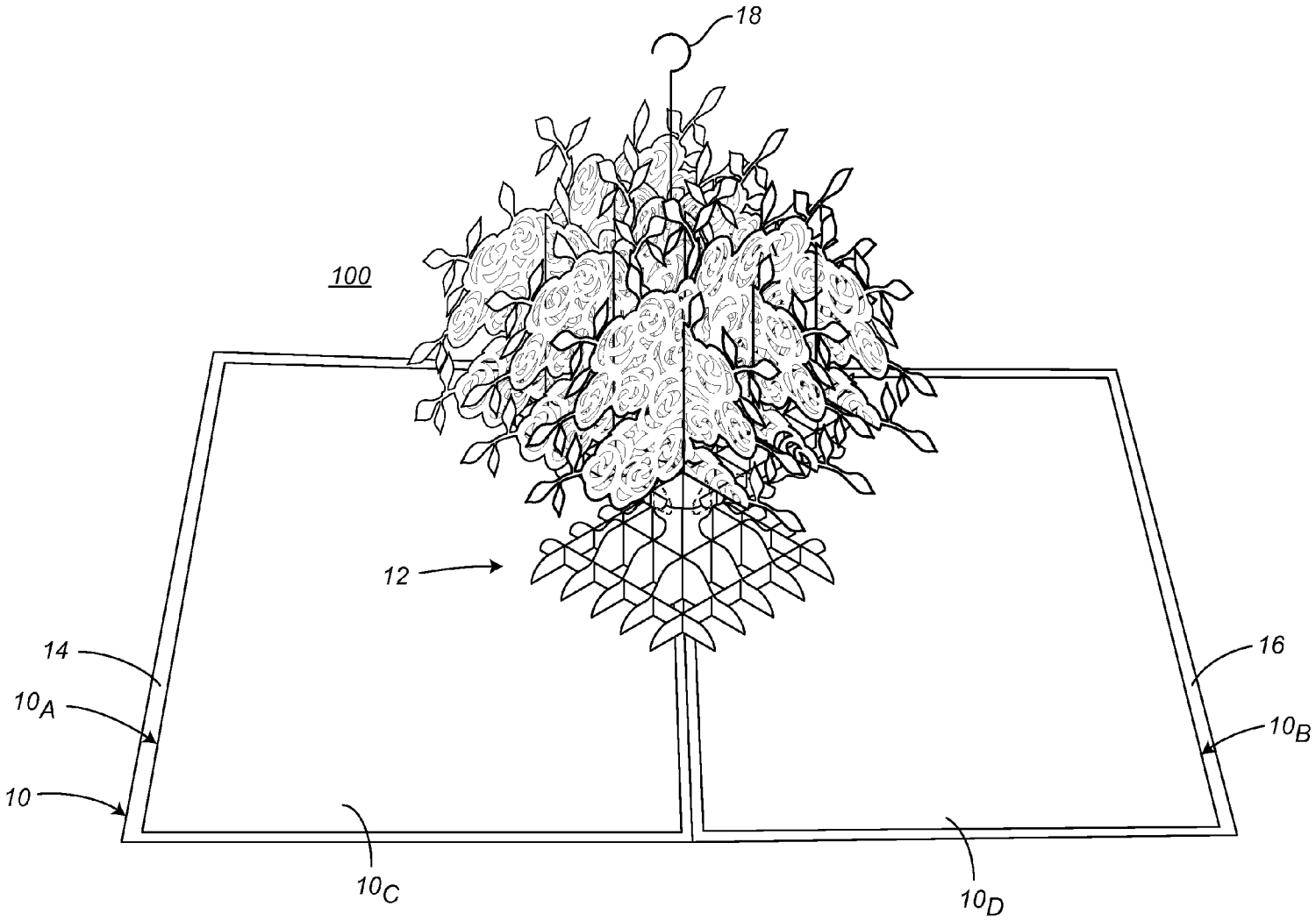
FIG. 2 is a top perspective view of the article seen in FIG. 1 with the article shown in an open configuration and the object shown in a expanded configuration.

Referring now to FIGS. 1 and 2, an article is disclosed that is identified generally by the reference character 100. While the article 100 is shown in FIGS. 1 and 2 as a greeting card, in alternate aspects of the present disclosure, the article 100 may assume other forms, such as, for example, a book or a poster, without departing from the scope of the present disclosure.

The article 100 may be formed from any suitable material including, for example, paper, cardboard, oak tag, plastics, polymers, one or more textiles, one or more light-weight metals or woods, or combinations thereof, and includes a plurality of panels 10, as well as an object 12 (FIG. 2) that is removably secured to the panels 10. Specifically, in the embodiment shown in FIGS. 1 and 2, the article 100 includes a first (top) panel $\mathbf{10}_A$, a second (bottom) panel $\mathbf{10}_B$ connected to the first (top) panel $\mathbf{10}_A$, a third panel $\mathbf{10}_C$ connected to an inner surface 14 of the first (top) panel $\mathbf{10}_A$, and a fourth panel $\mathbf{10}_D$ connected to an inner surface 16 of the second (bottom) panel $\mathbf{10}_B$. The panels 10 may be connected to one another either fixedly, or in a manner permitting separation of the panels 10. For example, the first (top) panel $\mathbf{10}_A$ may be connected to the second (bottom) panel $\mathbf{10}_B$ by a perforated hinge, and/or the third and fourth panels $\mathbf{10}_C$, $\mathbf{10}_D$ may be respectively connected to the inner surfaces 14, 16 of the first (top) panel $\mathbf{10}_A$ and the second (bottom) panel $\mathbf{10}_B$ via a releasable adhesive.

The panels $\mathbf{10}_A$, $\mathbf{10}_B$ and the panels $\mathbf{10}_C$, $\mathbf{10}_D$ may be either unitarily formed, or may be formed as separate, discrete structures. For example, in one embodiment, shown in FIG. 2, the panels $\mathbf{10}_A$, $\mathbf{10}_B$ may be unitarily formed, e.g., connected by a first living hinge, whereas the panels $\mathbf{10}_C$, $\mathbf{10}_D$ may be formed as separate, discrete structures. In alternate embodiments, however, the panels $\mathbf{10}_C$, $\mathbf{10}_D$ may be unitarily formed, e.g., connected by a second living hinge, or each of the panels $\mathbf{10}_A$-$\mathbf{10}_D$ may be formed as a separate, discrete structure.

Figure 3:
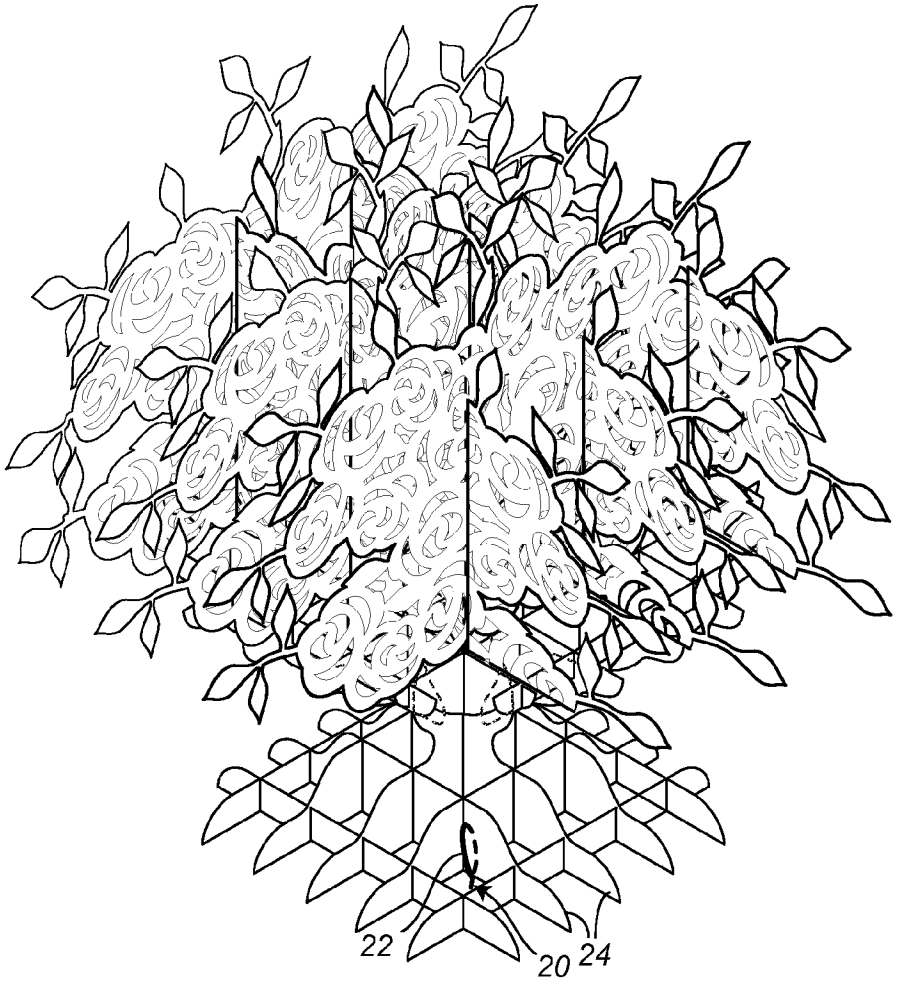
FIG. 3 is a top perspective view of the object.
Figure 4:
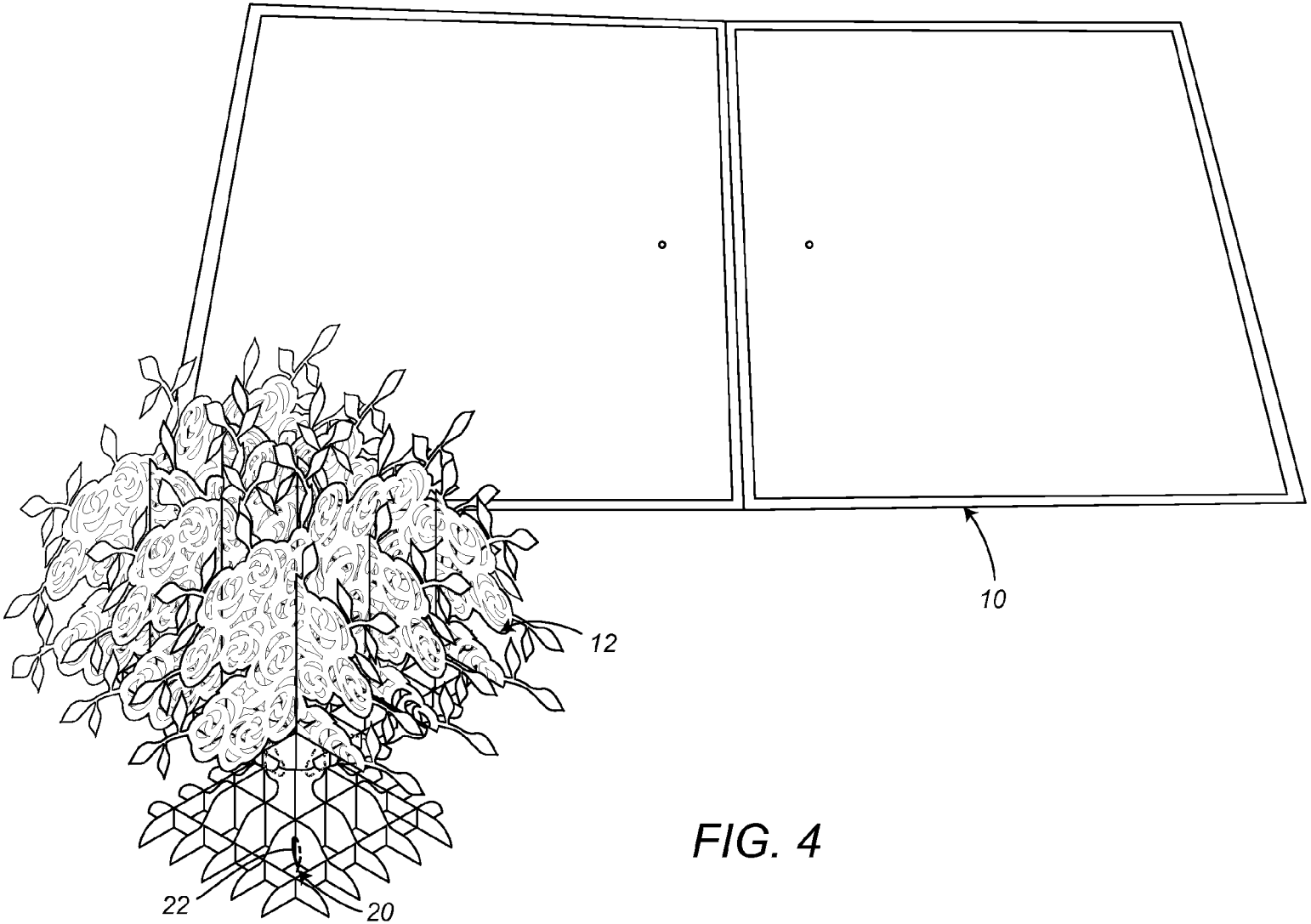
FIG. 4 is a top perspective view of the article with the object removed (detached) therefrom.

With reference now to FIGS. 3 and 4 as well, the object 12 will be discussed. Although the object 12 is generally illustrated as a bouquet of flowers, the object 12 may assume a variety of alternate configurations, and may include varying coloration, without departing from the scope of the present disclosure. For example, the object 12 may be configured as a Christmas tree, a bouquet of roses (either with or without a vase), a bouquet of lilies (either with or without a vase), a vase, a Ferris wheel, a hanging clothes line, a church, a church together with a horse and carriage, a horse with a center heart, Cupid with a tree of hearts, one or more presents (either with or without bows), a ship (either with or without a sail), the Church of Notre Dame, a bird house (either with or without flowers), the Eiffel Tower, the Arch de Triumph, London Bridge, Big Ben, a pagoda, a baby (either with or without a stroller), and various items associated with a baby shower.

The object 12 may include a display member 18 (FIG. 2), such as a hook, loop of string, adhesive, or the like, such that the object 12 can be displayed following removal from the panels 10. For example, the object 12 may be separated from the panels 10 and displayed in a window, on a refrigerator, hung on a wall, or placed on a mantle or shelf. The display member 18 may be positioned in any suitable location(s) to facilitate display in the manner described, e.g., adjacent an upper portion of the object 12, on a front surface of the object 12, and/or on a rear surface of the object 12.

It is also envisioned that the object 12 may incorporate a perfume or other such odoriferous substance such that the object 12 may act as an air freshener.

To facilitate removal of the object 12 from the panels 10, the article 100 may further include one or more attachment members 20 (FIGS. 3, 4) that can be cut, severed, etc. to permit removal of the object 12 from the article 100. For example, as shown in FIGS. 3 and 4, the object 12 may be removably connected to the article 100 by a tether 22 that extends between the object 12 and one or more of the panels 10. For example, the tether 22 may extend between the first (top) panel $\mathbf{10}_A$ and the third panel $\mathbf{10}_C$ (FIG. 2), and/or between the second (bottom) panel $\mathbf{10}_B$ and the fourth panel $\mathbf{10}_D$. Alternatively, the tether 22 may be connected to one or more exposed surfaces of the panels 10, e.g., the third panel $\mathbf{10}_C$ and/or the fourth panel $\mathbf{10}_D$.

In alternate embodiments of the present disclosure, the attachment member(s) 20 may be configured as one or more magnets, an adhesive, one or more perforations, or any other structure suitable for the intended purpose of permitting removal of the object 12 from the article 100 without causing unintended physical alteration of the collateral portions of the article 100, e.g., ripping, tearing, or other such damage to the panels 10. For example, the object 12 may be removably connected to the article 100 by one or more portions, e.g., integral flaps, that can be inserted into and removed from corresponding apertures, openings, or pockets formed in the panels 10.

The article 100 is repositionable between a first (closed) configuration (FIG. 1), in which the object 12 is collapsed within the article 100, and a second (open) configuration (FIG. 2), in which the three-dimensional object 12 is expanded. The attachment member(s) 20 may connect the object 12 to the article 100 such that the object 12 is expanded as the article 100 is repositioned from the first (closed) configuration into the second (open) configuration, and collapsed as the article 100 is repositioned from the second (open) configuration into the first (closed) configuration. To facilitate repositioning of the article 100 between the first (closed) configuration (FIG. 1) and the second (open) configuration (FIG. 2), the object 12 may be formed from, or include, a plurality of individual members 24 that are arranged in a woven, interleaved, or other such suitable pattern permitting expansion and collapse of the object 12.

Rather than a single object 12, as seen in FIG. 2, the article 100 may include a plurality of objects 12 that may be connected to, or associated with, one another. For example, the article 100 may include a primary object, e.g., in the form of a Christmas tree or a vase, as well as one or more secondary objects, e.g., in the form of Christmas tree ornaments or individual flowers. In such embodiments, following separation of the primary and secondary objects from the article 100, the secondary objects may be used to adorn the primary object. For example, LED lights may be provided to illuminate the object(s) 12.

It is also envisioned that several articles 10 may be designed as a series according to a particular theme, and that the object 12 from one article 100 in the series may be connected to, or associated with, the object 12 from another article in the series.

In another embodiment of the disclosure, it is contemplated that the object 12 may be fixedly connected to the article 100. For example, the object 12 may be integrally formed with one or more of the panels 10, e.g., the third panel $\mathbf{10}_C$ and/or the fourth panel $\mathbf{10}_D$ (FIG. 2), which may be removably connected to the respective first and second panels $\mathbf{10}_A$, $\mathbf{10}_B$ by the attachment member(s) 20.

In another embodiment of the disclosure, it is contemplated that the article 100 may be devoid of the aforedescribed third and fourth panels $\mathbf{10}_C$, $\mathbf{10}_D$ (FIG. 2), respectively, thus including only the first (top) panel $\mathbf{10}_A$ and the second (bottom) panel $\mathbf{10}_B$. In this embodiment, it is envisioned that the object 12 may be directly connected to the first (top) panel $\mathbf{10}_A$ and/or the second (bottom) panel $\mathbf{10}_B$.

Figure 5:
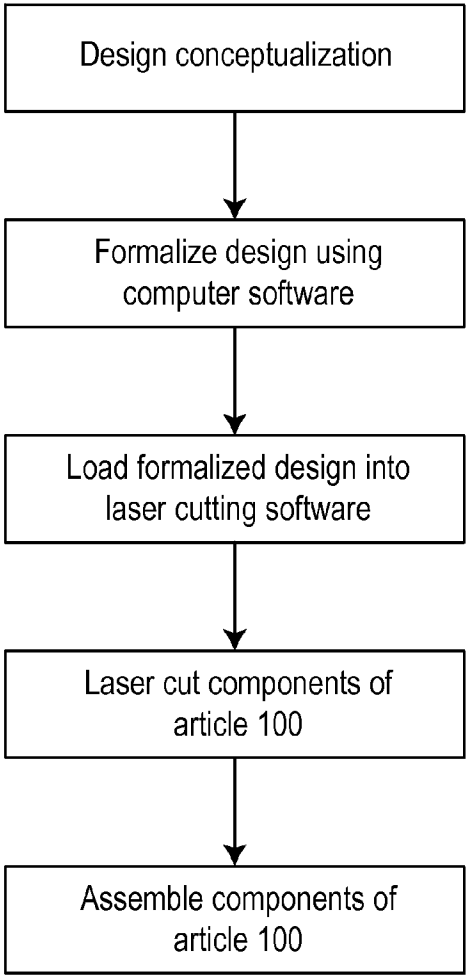
FIG. 5 illustrates a method for manufacturing the presently disclosed article.

Various methods of manufacture may be used in construction of the article 100. For example, one or more portions of the article 100, e.g., the object 12, may be formed by hand, as by cutting. Additionally, or alternatively, one or more portions of the article 100, e.g., the object 12, may be formed using more mechanized methods, such as, for example, laser machining. With reference to FIG. 5, for example, in one method of manufacture, following the conceptualization of a design, the design is formalized using suitable computer software, and a prototype is created to test feasibility and operability of the design. The design is then uploaded into laser cutting software used in connection with a laser machining device, and the laser machining device is utilized to machine the material from which the article 100 will be formed, after which, the various components of the article 100 may be assembled.

Referring now to FIGS. 1-4, use of the article 100 will be discussed. Initially, the article 100 is removed from any protective wrapping (not shown), e.g., an envelope, sleeve, or the like, and is repositioned from the first (closed) configuration (FIG. 1) to the second (open) configuration (FIG. 2) to expand the three-dimensional object 12. Thereafter, the object 12 is separated from the article 100, e.g., by cutting the attachment members 20 (FIGS. 3, 4).

Following separation of the object 12 from the article 100, the display member 18 (FIG. 2) may be connected to the object 12 to facilitate display of the object 12. Alternatively, it is envisioned that the article 100 may be provided with the display member 18 pre-connected to the object 12.

With reference now to FIGS. 6-9, various alternate embodiments of the presently disclosed object will be described. Each embodiment of the object described in connection with FIGS. 6-9 below is identical to the object 12 discussed above in connection with FIGS. 1-4, but for any distinctions that are specifically noted. Accordingly, a discussion of certain features common to the aforedescribed object 12 and the various embodiments discussed below may be omitted in the interest of brevity.

Figure 6:
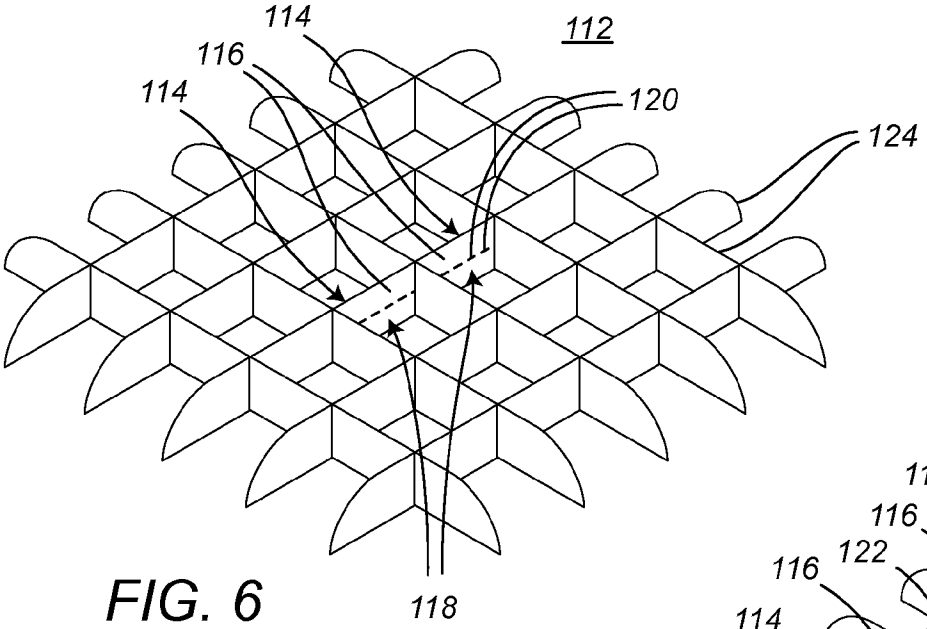
FIG. 6 is a bottom perspective view of one embodiment of the presently disclosed object including a locking member shown in a first (unlocked) configuration.
Figure 7:
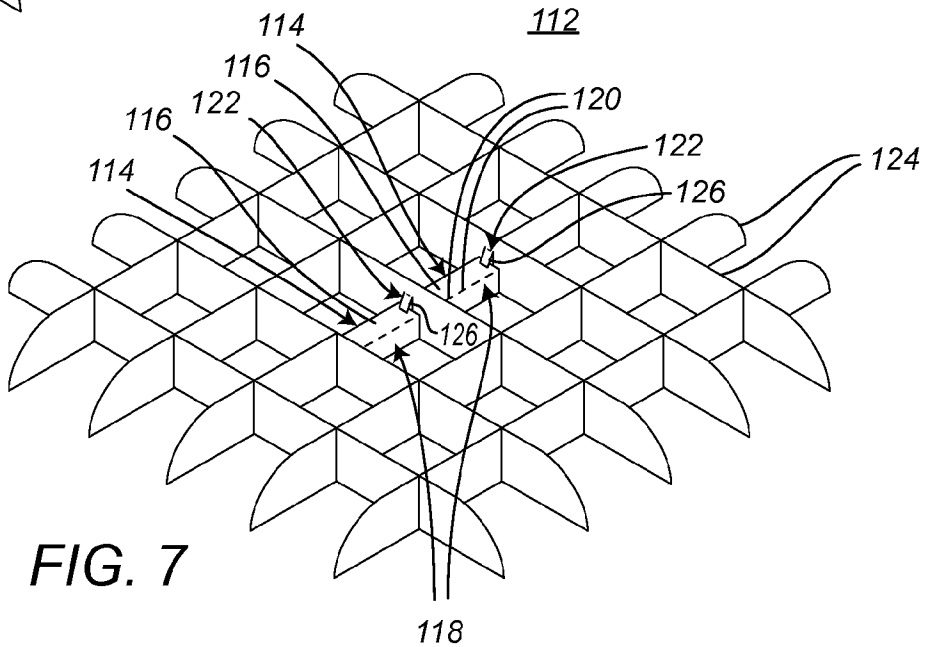
FIG. 7 is a bottom perspective view of the object seen in FIG. 6 showing the locking member in a second (locked) configuration.

With reference to FIGS. 6 and 7 in particular, an object 112 is disclosed that includes a plurality of individual members 124, and one or more locking members 114 that are configured and dimensioned to maintain the expanded configuration of the object 112. Although a pair of locking members 114 are included in the illustrated embodiment, the number of locking members 114 may be increased or decreased in alternative embodiments of the object 112 without departing from the present disclosure. For example, the object 112 may include a single locking member 114.

In the specific embodiment illustrated in FIGS. 6 and 7, each locking member 114 includes a deflectable tab 116 that is defined by a portion of one of the individual members 124 comprising the object 112. The tab 116 is movable between a first (unlocked) position (FIG. 6), wherein the tab 116 permits relative movement between the individual members 124, and thus, collapse of the object 112, and a second (locked) position (FIG. 7), wherein the tab 116 inhibits relative movement between the individual members 124, and thus, collapse of the object 112. More specifically, in the first (unlocked) position (FIG. 6), the tab 116 and the corresponding member 124 are oriented in parallel relation such that the tab 116 does not interfere with expansion and/or collapse of the object 112, whereas in the second (locked) position (FIG. 7), the tab 116 is oriented in transverse, e.g., orthogonal, relation to the corresponding member 124. In this orientation, abutment of the tab 116 with another member 124 comprising the object 112 inhibits collapse of the object 112.

In various alternate embodiments of the object 112, it is envisioned that the locking member(s) 114 may be configured and dimensioned so as to permit controlled collapse of the object 112 prior to locking. For example, the locking member(s) 114 may be configured and dimensioned to permit the object 112 to collapse to a predetermined extent short of complete collapse to achieve a particular aesthetic of the object 112 to be maintained upon locking. Additionally, or alternatively, the locking member(s) 114 may be configured and dimensioned to permit collapse of the object 112 according to a predetermined progression, whereby the locking member(s) 114 may be used to lock the object 112 at various points in time during collapse.

In the embodiment of the object 112 illustrated in FIGS. 6 and 7, each of the locking members 114 is integrally formed with the object 112. Specifically, the tab 116 is defined by a weakened portion 118, e.g., one or more perforations 120, formed in one of the individual members 124 of the object 112. Following expansion of the object 112, each locking member 114 may be actuated via the application of a force, e.g., by the user, to thereby separate each locking member 114 from the individual member 124 along the weakened portion 118 to permit deflection of the tab 116, and movement into the second (locked) position (FIG. 7).

Figure 8:
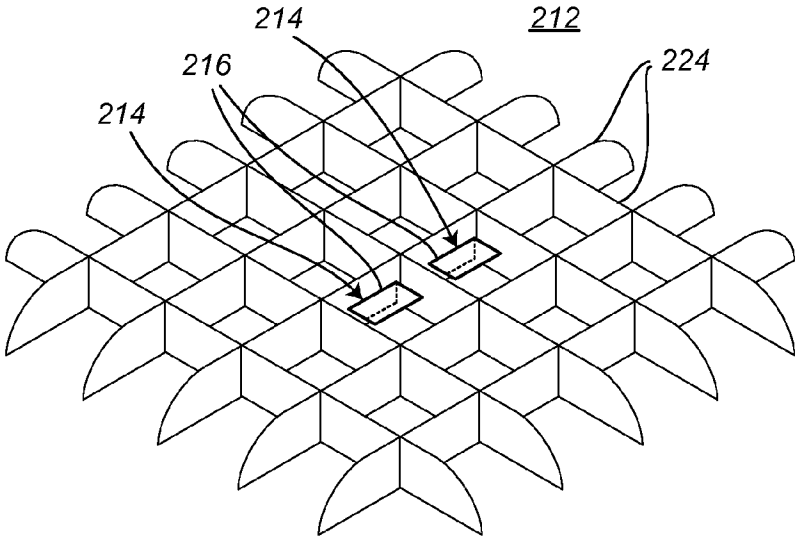
FIG. 8 is a bottom perspective view of an alternate embodiment of the presently disclosed object and locking member.

In an alternate embodiment, illustrated in FIG. 8, an object 212 is disclosed including one or more locking members 214 that are configured as a separate, discrete structures. In this embodiment, the locking member(s) 214 are connected to one of the individual members 224 comprising the object 212 by a living hinge 216 to permit movement between the aforedescribed first (unlocked) and second (locked) positions.

Figure 9:
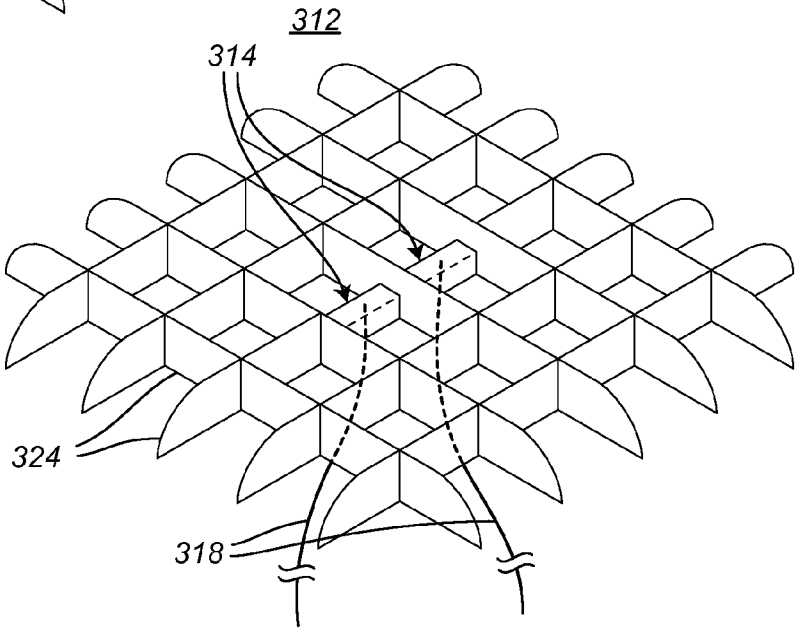
FIG. 9 is a bottom perspective view of an alternate embodiment of the presently disclosed object and locking member.

With reference again to FIGS. 6 and 7, in the illustrated embodiment, each locking member 114 is configured and dimensioned for manual actuation, i.e., movement between the first (locked) position and the second (unlocked) position, by the user. With reference to FIG. 9, however, an object 312 is disclosed including one or more locking members 314, two being shown in the illustrated embodiment, that are biased towards the second (locked) position by one or more biasing members 318, e.g., springs, rubber bands, or the like. For example, the biasing member(s) 318 may include a first end connected to the locking member(s) 314, and a second that is anchored to a body portion of the object 312. In alternative embodiments, it is envisioned that the biasing member(s) 318 may be positioned and oriented in any other manner suitable for the intended purpose of biasing the locking member(s) 314 towards the second (locked) position, e.g., the biasing member(s) 318 may be located between the locking member(s) 314 and one of the individual members 324 comprising the object 312.

The biasing member(s) 318 facilitate repositioning of the locking member(s) 314 between the first (unlocked) position and the second (locked) position. Specifically, when the object 312 is collapsed, i.e., when the article 100 is in the first (closed) configuration (FIG. 1), the biasing member(s) 318 are under tension such that upon expansion of the object 312 to a predetermined extent, i.e., during movement of the article 100 into the second (open) configuration (FIG. 2), the locking member 314 is automatically actuated, thereby obviating any need for manual manipulation of the locking member 314 by the user.

With reference again to FIGS. 6 and 7, the object 112 may further include one or more retention structures 122 that are engageable with each locking member 114 to secure the locking member(s) 114 in the second (locked) position. For example, the object 112 may include one or more protrusions 126 (FIG. 7), e.g., ribs, detents, shoulders, ridges, or the like, beneath which the locking member(s) 114 may be passed during movement from the first (unlocked) position (FIG. 6) to the second (locked) position (FIG. 7). After movement into the second (locked) position, engagement of the locking member(s) 114 with the retention structure(s) 122 acts to resist unintended return of the locking member(s) 114 to the first position, and thus, unintended collapse of the object 112.

With continued reference to FIGS. 6 and 7, use of the article 112 will be discussed in connection with the article 100 (FIGS. 1, 2). Following expansion of the object 112, and separation of the object 112 from the article 100, e.g., by cutting the attachment members 20 (FIGS. 3, 4), the locking member(s) 114 are actuated to assist in maintaining the expanded configuration of article 112 by moving the locking member(s) 114 from the first (unlocked) position (FIG. 6) to the second (locked) position (FIG. 7). Specifically, the tab(s) 116 are deflected, e.g., by causing separation along the perforation(s) 120. If necessary, or desirable, the locking member(s) 114 may be engaged with the retention structure(s) 122 (FIG. 7) to assist in maintaining the second (locked) position of the locking member(s) 114, and thus, expansion of the object 112.

Following separation of the object 112 from the article 100 in the manner discussed above, and actuation of the locking member(s) 114, the object 112 may be displayed.

Figure 11:
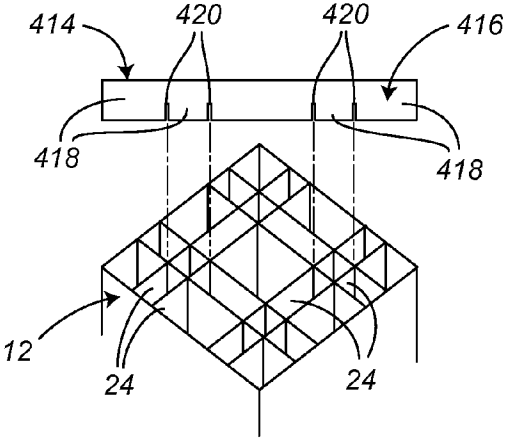
FIG. 11 is a top perspective view of the locking member of FIG. 10 shown in connection with an embodiment of the presently disclosed object.
Figure 10:
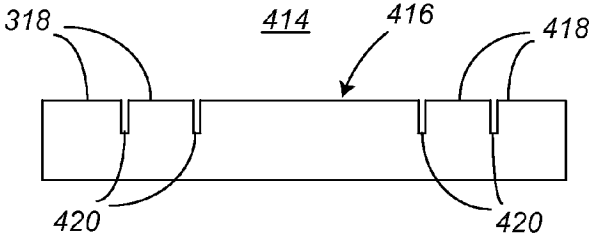
FIG. 10 is a side elevational view of an alternate embodiment of the presently disclosed locking member.

With reference now to FIGS. 10 and 11, an alternate embodiment of the locking member, which is identified generally by the reference character 414, will be discussed in connection with the object 12 (FIGS. 2-4). The locking member 414 includes a brace 416 having a configuration and dimensions that correspond to the configuration and dimensions defined by the object 12 in the expanded configuration. Specifically, the brace 416 is configured and dimensioned for engagement with the individual members 24 of the object 12, as seen in FIG. 11, and includes locking portions 418 that are positionable within the space defined between the individual members 24 upon expansion of the object 12 to inhibit relative movement between the individual members 24, and thus, collapse of the object 12.

In the specific embodiment of the locking member 414 illustrated in FIGS. 10 and 11, the brace 416 is linear in configuration, and includes several cutouts 420 that define the locking portions 418, and receive the individual members 24 of the object 12. In alternative embodiments, however, the locking member 414 may assume alternate configurations without departing from the scope of the present disclosure, several examples of which are described below.

With continued reference now to FIGS. 10 and 11, use of the locking member 414 will be discussed in connection with the article 100 (FIGS. 1-4) and the object 12. Following expansion of the object 12, and separation of the object 12 from the article 100, e.g., by cutting the attachment members 20 (FIGS. 3, 4), the object 12 is inverted, and the locking member 414 is engaged with the object 12. Specifically, the locking member 414 is oriented such that the cutouts 420 receive the individual members 24 of the object 12, and the locking portions 418 are positioned within the space defined between the corresponding individual members 24, thereby inhibiting relative movement between the individual members 24, and thus, collapse of the object 12.

Following engagement of the locking member 414 and the object 12, the object 12 may be displayed.

Figure 14:
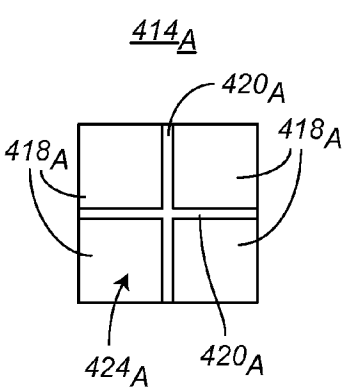
FIG. 14 is a top plan view of the locking member of FIG. 12.
Figure 13:
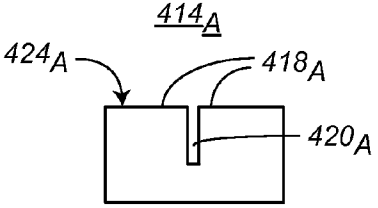
FIG. 13 is a side elevational view of the locking member of FIG. 12.
Figure 12:
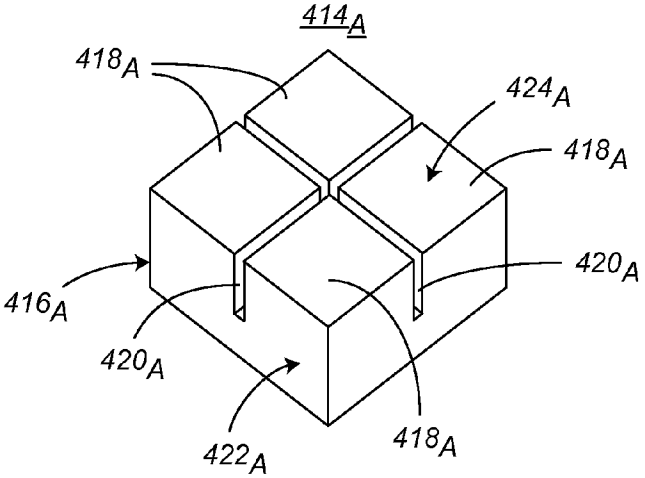
FIG. 12 is a top perspective view of an alternate embodiment of the presently disclosed locking member.

FIGS. 12-14 illustrate another embodiment of the locking member, identified by the reference character $\mathbf{414}_A$, that includes a brace $\mathbf{416}_A$ (FIG. 2) having a configuration and dimensions that correspond to the configuration and dimensions defined by the object 12 (FIGS. 2-4) in the expanded configuration. Specifically, the brace $\mathbf{416}_A$ is polygonal in configuration, and includes a quadrilateral body $\mathbf{422}_A$ (FIG. 12) with a planar top surface $\mathbf{424}_A$ that includes a plurality of cutouts $\mathbf{420}_A$ defining locking portions $\mathbf{418}_A$. Following expansion of the object 12, upon engagement of the locking member $\mathbf{414}_A$ and the object 12, the cutouts $\mathbf{420}_A$ receive the individual members 24 (FIG. 3) of the object 12, and the locking portions $\mathbf{418}_A$ are positioned within the space defined between the individual members 24, thereby inhibiting relative movement between the individual members 24, and thus, collapse of the object 12.

Figure 16:
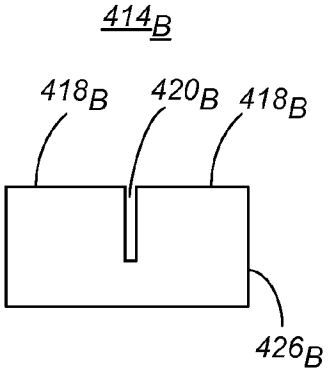
FIG. 16 is a side elevational view of the locking member of FIG. 15.
Figure 17:
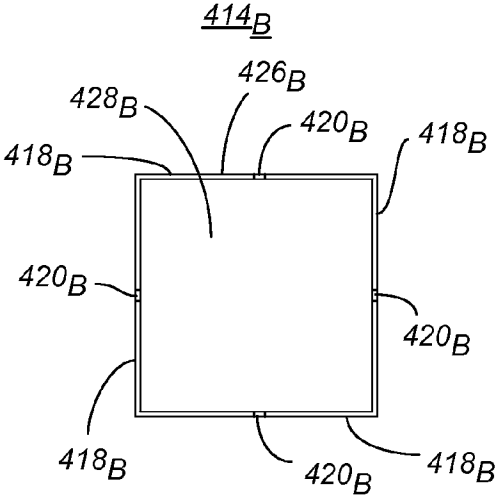
FIG. 17 is a top plan view of the locking member of FIG. 15.
Figure 15:
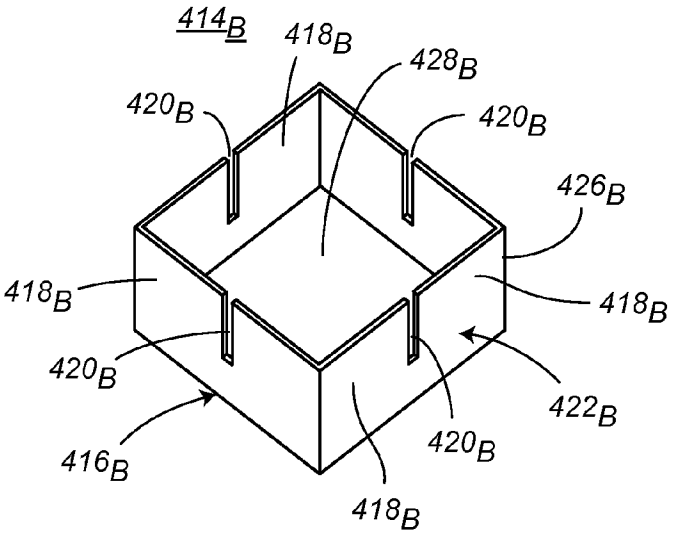
FIG. 15 is a top perspective view of an alternate embodiment of the presently disclosed locking member.

FIGS. 15-17 illustrate another embodiment of the locking member, identified by the reference character $\mathbf{414}_B$, that includes a brace $\mathbf{416}_B$ (FIG. 15) having a configuration and dimensions that correspond to the configuration and dimensions defined by the object 12 (FIGS. 2-4) in the expanded configuration. Specifically, the brace $\mathbf{416}_B$ includes a quadrilateral body $\mathbf{422}_B$ defined by an outer wall $\mathbf{426}_B$. The outer wall $\mathbf{426}_B$ defines a hollow interior space $\mathbf{428}_B$, and includes a plurality of cutouts $\mathbf{420}_B$ defining locking portions $\mathbf{418}_B$. Following expansion of the object 12, upon engagement of the locking member $\mathbf{414}_B$ and the object 12, the cutouts $\mathbf{420}_B$ receive the individual members 24 (FIG. 3) of the object 12, and the locking portions $\mathbf{418}_B$ are positioned within the space defined between the individual members 24, thereby inhibiting relative movement between the individual members 24, and thus, collapse of the object 12.

Figure 19:
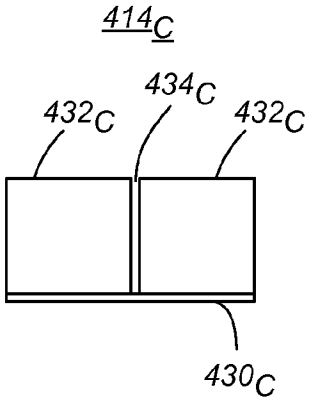
FIG. 19 is a side elevational view of the locking member of FIG. 18.
Figure 20:
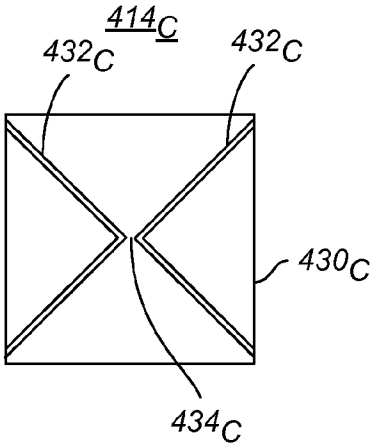
FIG. 20 is a top plan view of the locking member of FIG. 18.
Figure 18:
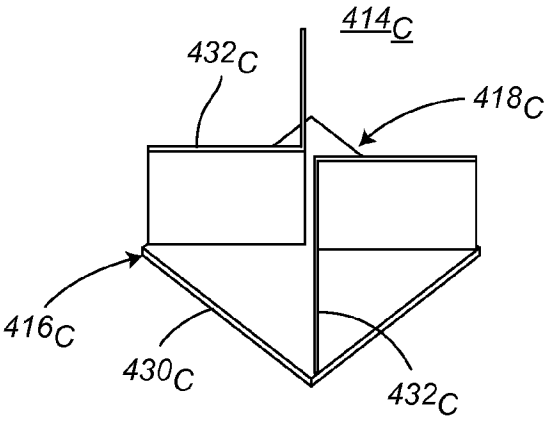
FIG. 18 is a top perspective view of an alternate embodiment of the presently disclosed locking member.

FIGS. 18-20 illustrate another embodiment of the locking member, identified by the reference character $\mathbf{414}_C$, having a configuration and dimensions that correspond to the configuration and dimensions defined by the object 12 (FIGS. 2-4) in the expanded configuration. The locking member $\mathbf{414}_C$ includes a brace $\mathbf{416}_C$ having a planar base portion $\mathbf{430}_C$, and a locking portion $\mathbf{418}_C$ (FIG. 18) that includes a plurality of upstanding, V-shaped struts $\mathbf{432}_C$ defining a channel $\mathbf{434}_C$ therebetween. Following expansion of the object 12, upon assembly with the object 12, the struts $\mathbf{432}_C$ are positioned within the space defined between the individual members 24 (FIG. 3) of the object 12, one of which is received by the channel $\mathbf{434}_C$, thereby inhibiting relative movement between the individual members 24, and thus, collapse of the object 12.

Persons skilled in the art will understand that the various exemplary aspects of the present disclosure described herein, and shown in the accompanying figures, constitute non-limiting examples of the present disclosure, and that additional components and features may be added to any of the embodiments discussed herein above without departing from the scope of the present disclosure. For example, although generally described as a component of the article 100 throughout the present disclosure, it is envisioned that the various embodiments of the object described herein may be provided independently of the article 100 as a stand alone item. In such embodiments, it is envisioned that the individual members 24 of the object 12 may be provided and assembled by the user, as opposed to be provided in pre-assembled form.

Additionally, persons skilled in the art will understand that the elements and features shown or described in connection with one example of the present disclosure may be combined with those of another without departing from the scope of the present disclosure, and will appreciate further features and advantages of the presently disclosed subject matter based on the description provided.

What is claimed is:

1. A greeting card comprising:

a plurality of panels connected such that the greeting card is reconfigurable between a closed configuration and an open configuration;

at least one object positioned between the plurality of panels, the at least one object being reconfigurable between a collapsed configuration and an expanded configuration, the at least one object being detachably connected to the plurality of panels such that movement of the greeting card from the closed configuration to the open configuration transitions the at least one object from the collapsed configuration to the expanded configuration, and movement of the greeting card from the open configuration to the closed configuration transitions the at least one object from the expanded configuration to the collapsed configuration; and an attachment member connecting the at least one object to the plurality of panels such that the at least one object can be selectively detached from the plurality of panels, wherein the plurality of panels, the at least one object, and the attachment member are formed as separate, discrete structures, wherein the attachment member includes a tether extending between the at least one object and the plurality of panels, wherein the plurality of panels includes a first outer panel, a second outer panel connected to the first outer panel, a first inner panel connected to an inner surface of the first outer panel, and a second inner panel connected to an inner surface of the second outer panel, a portion of the tether passing between the first outer panel and the first inner panel, and a portion of the tether passing between the second outer panel and the second inner panel.

2. The greeting card of claim 1, wherein the at least one object includes a plurality of individual members in mechanical cooperation so as to define a predetermined shape when the at least one object is in the expanded configuration.

3. A greeting card comprising:

a plurality of panels;

at least one object positioned between the plurality of panels, the at least one object being reconfigurable between a collapsed configuration and an expanded configuration; and a locking member configured and dimensioned to maintain the expanded configuration of the at least one object, wherein the at least one object includes a plurality of individual members in mechanical cooperation so as to define a predetermined shape when the at least one object is in the expanded configuration, wherein the locking member is defined by a portion of the at least one object, wherein the locking member is integrally formed with one of the plurality of individual members of the at least one object, wherein the locking member includes a deflectable tab movable between a first position, wherein the tab permits collapse of the at least one object, and a second position, wherein the tab inhibits collapse of the at least one object, wherein the deflectable tab is defined by a weakened portion of the individual member with which the locking member is formed.

4. The greeting card of claim 3, wherein the object further includes a retention structure engageable with the locking member to maintain the locking member in a locked position.

5. The greeting card of claim 3 further including an attachment member connecting the at least one object to the plurality of panels such that the at least one object can be selectively detached from the plurality of panels.

6. The greeting card of claim 5, wherein the plurality of panels, the at least one object, and the attachment member are formed as separate, discrete structures.

7. A greeting card comprising:

a plurality of adjacent panels;

at least one object positioned between the plurality of panels, the at least one object being reconfigurable between a collapsed configuration and an expanded 3D configuration; and a locking member configured and dimensioned to maintain the expanded configuration of the at least one object, wherein the at least one object includes a plurality of individual members in mechanical cooperation so as to define a predetermined shape when the at least one object is in the expanded configuration, wherein the locking member is configured and dimensioned in correspondence with the at least one object in the expanded configuration such that the locking member is engageable with the plurality of individual members of the at least one object to lock the at least one object in the expanded configuration.

8. The greeting card of claim 7, wherein the at least one object and the locking member are formed as separate, discrete structures.

9. The greeting card according to claim 7, wherein the adjacent panels define a fold therebetween.

10. A greeting card comprising:

a plurality of adjacent panels; and at least one object positioned between the plurality of panels, the at least one object being reconfigurable between a collapsed configuration and an expanded 3D configuration, the at least one object including:

a plurality of individual members in mechanical cooperation so as to define a predetermined shape when the at least one object is in the expanded configuration; and a locking member configured and dimensioned to maintain the expanded configuration of the at least one object, wherein the locking member is integrally formed with one of the plurality of individual members of the at least one object, wherein the locking member includes a deflectable tab movable between a first position, wherein the tab permits collapse of the at least one object, and a second position, wherein the tab inhibits collapse of the at least one object.

11. The greeting card according to claim 10, wherein the adjacent panels define a fold therebetween.

12. A greeting card comprising:

a plurality of adjacent panels; and at least one object positioned between the plurality of panels, the at least one object being reconfigurable between a collapsed configuration and an expanded 3D configuration, the at least one object including:

a plurality of individual members in mechanical cooperation so as to define a predetermined shape when the at least one object is in the expanded configuration; and a locking member configured and dimensioned to maintain the expanded configuration of the at least one object, wherein the at least one object further includes a retention structure engageable with the locking member to maintain the locking member in a locked position.

13. The greeting card according to claim 12, wherein the adjacent panels define a fold therebetween.

* * * * *